United States Patent [19]

Kobayashi et al.

[11] 4,379,355

[45] Apr. 12, 1983

[54] WASHING MACHINE FOR HOLLOWWARES

[75] Inventors: Kiyoshi Kobayashi, Noda; Shuji Suga, Fujishiro, both of Japan

[73] Assignee: Hukuba Kogyo Kabushiki Kaisha, Chiba, Japan

[21] Appl. No.: 270,831

[22] Filed: Jun. 5, 1981

[30] Foreign Application Priority Data

Feb. 6, 1981 [JP] Japan ..... 56-15480[U]
Feb. 16, 1981 [JP] Japan ..... 56-20470[U]

[51] Int. Cl.[3] ..... A47L 15/00
[52] U.S. Cl. ..... 15/101; 15/75
[58] Field of Search ..... 15/75, 76, 101, 56, 15/70, 71, 73, 21 R, 21 E

[56] References Cited

U.S. PATENT DOCUMENTS 1,142,716 6/1915 Kugel ..... 15/75
2,258,895 10/1941 Jakubowski ..... 15/76

*Primary Examiner*—Edward L. Roberts
*Attorney, Agent, or Firm*—Wenderoth, Lind & Ponack

[57] ABSTRACT

A washing machine for hollowware has a washing implement mounted on a rotating shaft projected outwardly from a casing of the machine. The washing implement is covered with a hollowware to be washed having a relatively deep depth through operation of an operator, and when the hollowware is moved by means of the operator's hand(s), the washing implement rotates while contacting with the inside of the hollowware thereby removing stains therefrom. The rotating shaft is connected to either a pinion meshing with a rack, or a rotary gear meshing with a stationary gear, so that when the hollowware is subjected to reciprocating motion or rotary motion, the rotating shaft rotates on its own axis.

9 Claims, 7 Drawing Figures

WASHING MACHINE FOR HOLLOWWARES

BACKGROUND OF THE INVENTION

This invention relates to a washing machine for hollowware, and more particularly to a washing machine utilized for washing hollowware having a comparatively deep depth such as cups, bowls and the like.

Heretofore there has been primarily a sponge, a handled sponge or the like as an instrument for washing the inner or outer surfaces of such type of hollowware. In operation, one end or handle of the sponge is held by one hand of an operator and another end of the sponge or handled sponge is inserted into the hollowware held by another hand to rub the inner surface of the hollowware, or the outer surface of the hollowware is rubbed with the aforesaid end of the sponge or handled sponge thereby washing the same. This washing method is simple and has been practised for a long time, but hollowware to be washed and a washing instrument must directly be touched with the hands. Accordingly this method has such inconveniences that there is required to uncomfortably steep the hands in a detergent or wash water, and in addition that there is required a troublesome operation that the inner surface of a hollowware having a relatively deep depth has to be rubbed always by means of both the hands of an operator. Furthermore there is also such inconvenience that in the case when the washing of the inner surface of a hollowware is followed by washing of the outer surface thereof, the same has to be rubbed with the washing instrument after changing the manner of holding the hollowware and washing instrument.

In order to reduce such disadvantages as mentioned above, there is a type of washing machine for hollowware in which a washing instrument is rotationally driven by a prime mover such as a motor and the like, and a hollowware is pushed onto the washing instrument thereby to obtain washing effects. However such washing machines as mentioned above are accompanied with such disadvantages of complicated and voluminous structures, so that most of such types of washing machine have not been suitable for ordinary household purposes. Japanese Utility Model Publication Nos. 38383/1975 and 15490/1979 disclose such conventional type washing machines for hollowware.

SUMMARY OF THE INVENTION

It is an object of the present invention to provide a washing machine for hollowware having a structure which can be relatively easily and manually operated and by which comparatively simple washing operation can be effected.

Another object of the invention is to provide a washing machine which is operated in such manner that a washing instrument or implement is covered with a hollowware having a relatively deep depth through operation of an operator, and then the hollowware is reciprocally moved by means of the operator's hand to reciprocally rotate the washing instrument inside the hollowware, whereby the inside thereof is rubbed with the washing instrument impregnated with a detergent to remove stains from the hollowware.

A further object of the invention is to provide a washing machine which is operated in such manner that a washing instrument is covered with a hollowware through operation of an operator, and then the hollowware is circularly moved by means of the operator's hand to rotate the washing instrument on its own axis, whereby stains are removed by means of such washing instrument from the inside of the hollowware.

A still further object of the invention is to provide a washing machine which is operated in such manner that a washing instrument is covered with a hollowware through operation of an operator, then the hollowware is circularly moved by means of the operator's hand to rotate the washing instrument on its own axis inside the hollowware thereby removing stains therefrom, and at the same time washing of the periphery and outer surface of the hollowware can also be effected by means of a contactor contacting with the periphery and outer surface of the hollowware.

According to the present invention, these objects can be realized by a construction which comprises a casing having stationary teeth and a rotary gear meshing therewith, a rotating shaft rotating together with the rotary gear and projecting outwardly from the casing, and a washing instrument mounted on the projected end of the rotating shaft.

The aforesaid washing instrument is covered with a hollowware to be washed through operation of an operator, and when the hollowware is moved by means of the operator's hand, the rotary gear moves relatively to the stationary teeth meshing therewith to rotate on its own axis, and thus the washing instrument rotates while contacting with the inside of the hollowware. As described above, in accordance with the invention, stains on the inside of a hollowware can be removed by such simple operation that the hollowware held by an operator's hand or hands is only moved by the operator.

More specifically, when a rack and a pinion meshing therewith are utilized as the stationary teeth and rotary gear, and further a stationary casing with the built-in rack and pinion is utilized as the casing, a washing machine for hollowwares of the present invention in which a hollowware can be washed by merely moving reciprocally the hollowware to be washed can be obtained. In case of this reciprocating motion, it is preferable that a guide hole extending along the longitudinal direction of the rack is provided on the casing, the rotating shaft connected to the pinion is projected through this guide hole, and at the same time the guide hole is made to be in cooperation with the reciprocating motion of the aforesaid rotating shaft, so that such reciprocating motion can smoothly be effected.

For a specific construction of this reciprocating motion, a bearer for hollowware formed by securing concentrically two annular resilient members is provided between the washing implement and casing, and as a result stability of the reciprocating motion increases. Furthermore a pair of rails are provided on the casing in right and left directions of the bearer for hollowware and when the bearer is slid on the rails, stability of the reciprocating motion is improved.

In addition, when the washing implement is detachably mounted on the extreme end of the rotating shaft, such washing implement conveniently may be exchanged with a new one.

In a specific construction of the washing implement or instrument, a pair of standing-up plates are extended from a base portion fitted to the rotating shaft, a washing material piece is held by sandwiching the same between the standing-up plates, and a stopper is further provided to insure the holding of these parts, so that exchange of such washing material piece can easily be effected.

Moreover, when a stationary gear and rotary gear being in gear therewith are utilized as the stationary teeth and rotary gear and further a rotary casing with the built-in stationary and rotary gears is utilized as the casing, a washing machine for hollowwares in which the hollowware can be washed by subjecting the hollowware to rotary motion can be obtained.

In connection with this rotary motion of a hollowware, a material piece for washing a peripheral portion of the hollowware is disposed on a position at which the hollowware contacts with a rotary box, and as a result the peripheral portion of hollowware can be washed simultaneously with that of the inside of the hollowware. Likewise in reference to rotary motion of a hollowware, when a material piece for washing an outer surface of the hollowware which contacts therewith is provided, the outer surface of the hollowware can be washed concurrently with that of the inner surface of the hollowware.

The above and other objects and advantages of the present invention will be fully understood from the following description setting forth preferred embodiments of the invention in connection with the attached drawings illustrating such embodiments.

DETAILED DESCRIPTION OF THE PREFERRED EMBODIMENTS

Figure 1:
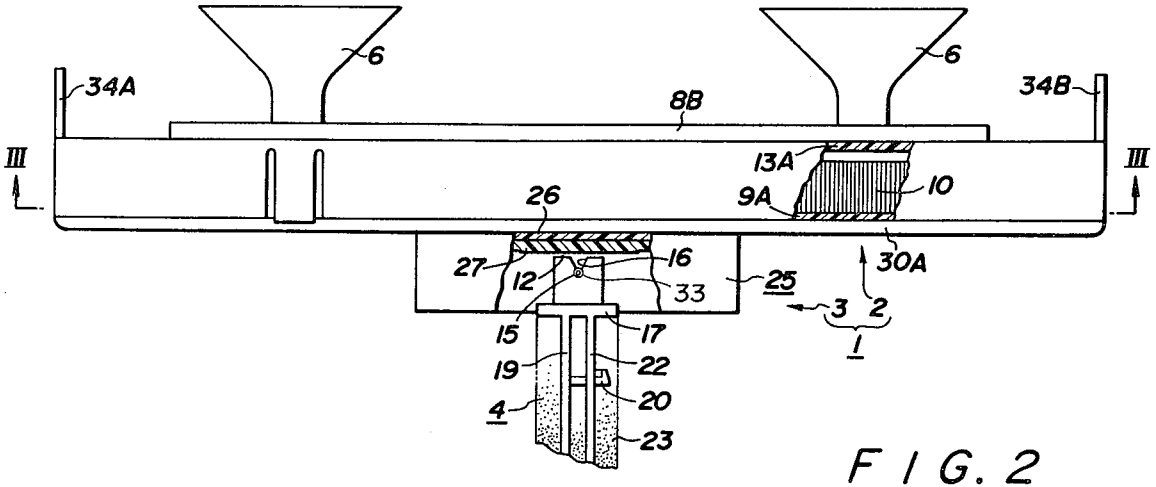
FIG. 1 is a partially cutaway plan view showing one embodiment of a washing machine for hollowwares in accordance with the present invention.
Figure 2:
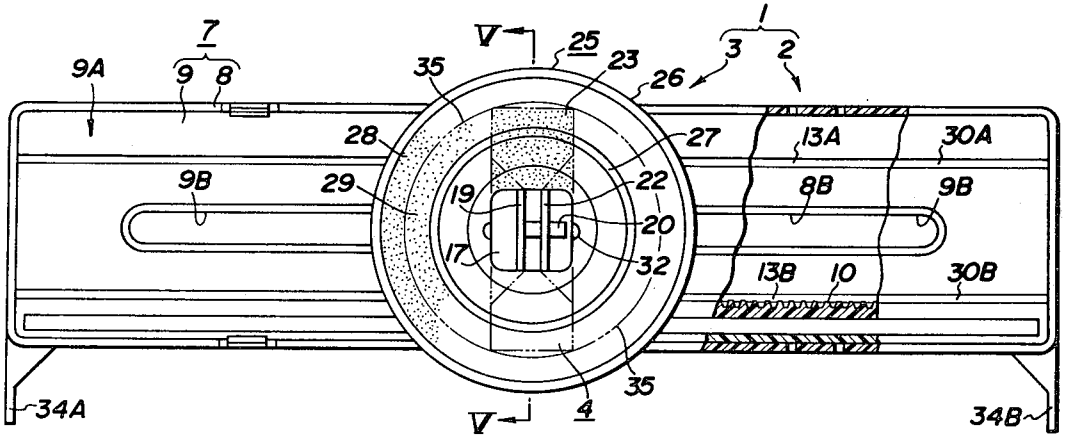
FIG. 2 is partially cutaway front view showing the washing machine of FIG. 1.
Figure 3:
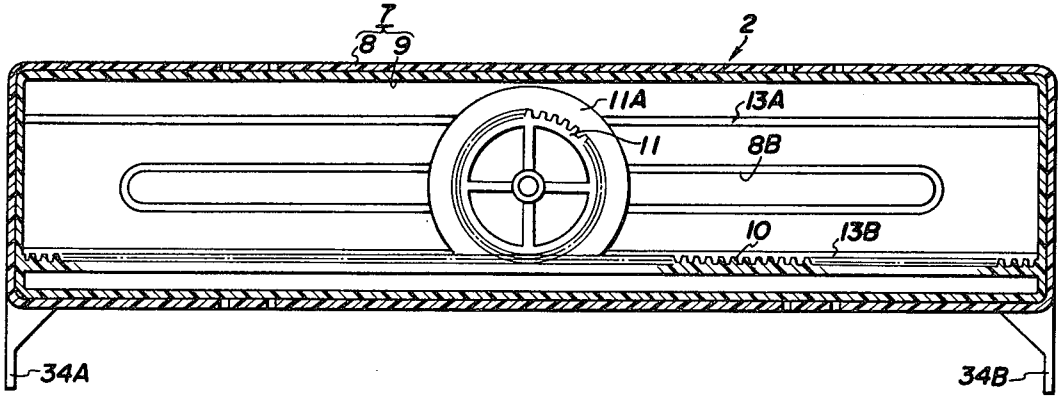
FIG. 3 is a sectional view taken along line III—III in FIG. 1.
Figure 4:
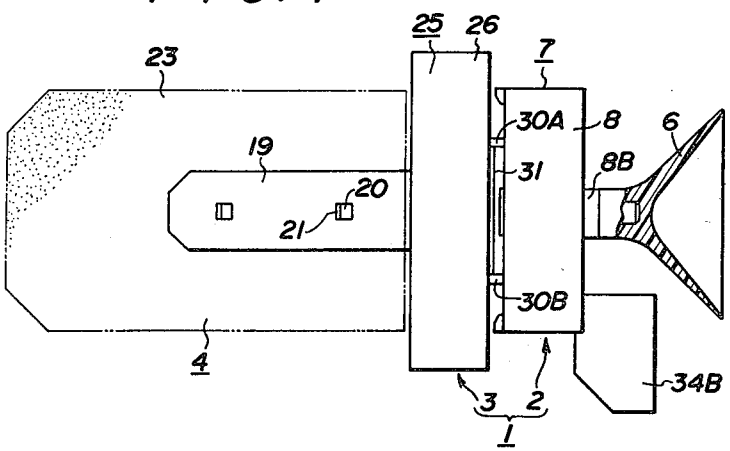
FIG. 4 is a partially cutaway side view showing the washing machine of FIG. 1.
Figure 5:
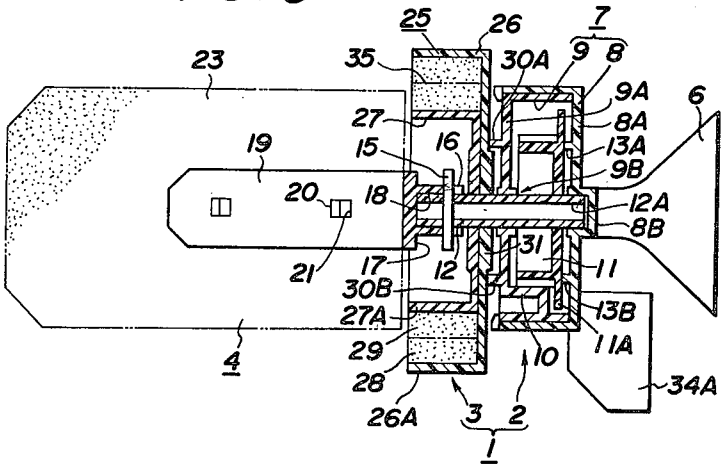
FIG. 5 is a sectional view taken along line V—V in FIG. 2.

In FIGS. 1 through 5, inclusive, there is shown one embodiment of a washing machine 1 for hollowware according to the present invention which comprises a base portion 2 and a washing implement or instrument portion 3, the washing implement portion 3 being manually operated to effect reciprocating motion with respect to the base portion 2 thereby rotating a washing implement 4 on its own axis.

More specifically, the base portion 2 has a rectangular stationary casing 7 on the rear surface of which suction cups 6 and the like are fixed. The stationary casing 7 comprises a casing body 8 having a relatively long width in its horizontal direction and a comparatively low height, the front of the casing body being opened, and an oblong casing cover 9 having an opened back and which is fitted in the casing body 8 from the front thereof. A rack 10 extending in the right and left directions as viewed in the drawings, at a position of a lower portion in a rectangular inner space encircled by the casing body 8 and casing cover 9 is secured to the casing cover 9 as a part thereof. A pinion 11 gearing with the rack 10 is disposed at a substantially central position in the vertical direction of the inner space. The pinion 11 is an integral part of a hollow rotating shaft 12, the front end portion of which projects forwardly in a slidable and rotable manner through a guide window 9B bored in a front side plate 9A of the casing cover 9. On the other hand a rear end portion 12A of the rotating shaft 12 is fitted into a guide groove 8B provided on a rear side plate 8A of the casing body 8 so as to be opposed to the guide window 9B in a slidable and rotatable manner. The guide window 9B as well as guide groove 8B extend respectively in right and left directions so as to extend along the extending direction of the rack 10, whereby the rotating shaft 12 may slide in right and left directions through guidance of the guide window 9B and guide groove 8B. At this time since the pinion 11 gears with the rack 10, the pinion rotates so that the rotating shaft 12 is rotated.

A pair of rails 13A and 13B extending in right and left directions are provided at upper and lower positions of the rear side plate 8A, respectively, so as to interpose the guide groove 8B between the rails 13A and 13B on the inner surface of the rear side plate 8A of the casing body 8. A flange 11A for sliding movement is formed on the side surface of the pinion 11 facing the rails 13A and 13B, and when the pinion 11 moves in right and left directions while rotating, the flange 11A slidably contacts with the rails 13A and 13B, whereby the rotating shaft 12 may be transferred with favorable stability and low frictional resistance in accordance with the movement of the pinion 11.

A spring pin 15 is forcibly inserted in and fixed to a split groove 16 engaging with the spring pin in such a manner that the spring pin 15 pierces through the extreme end of the rotating shaft 12 in the diametral direction thereof. The washing implement 4, having a base part 17 to which the split groove 16 is provided, is engaged with washing implement portion 3 by inserting the rotating shaft 12 to a center hole portion 18 communicating with the split groove 16. The washing implement 4 is provided with a standing-up plate 19 extending forwardly from the base part 17 and a stopper plate 22 having an engaging hole 21 nesting with an engaging piece 20 projecting transversely from one side of the standing-up plate 19. A washing material piece, for example, a rotating sponge 23 is held by sandwiching the same between the standing-up plate 19 and the stopper plate 22. In this embodiment, the rotating sponge 23 is formed into a vertically elongated strip as a whole so as to be suitable for washing cups, and the size of the sponge is selected so as to sufficiently expand in the transverse and longitudinal directions from the standing-up plate 19 and stopper plate 22 towards the outside thereof.

Between the washing implement 4 and the base portion 2, a bearer 25 for hollowware is provided, so that the washing implement portion 3 is formed by the washing implement 4 and the bearer 25 for hollowware. The bearer 25 for hollowware comprises an outer holder 26 of cylindrical form having a relatively large diameter and the front of which is opened, and an inner holder 27 of cylindrical form having a comparatively small diameter and which is fitted into the outer holder 26 from the front thereof. The rotating shaft 12 is rotatably inserted through center hole portions of the outer and inner holders 26 and 27, respectively, thereby forming an annular space between the respective peripheral plate portions 26A and 27A of both the holders with the rotating shaft 12 as its center. Onto the inner surface of the peripheral plate portion 26A of the outer holder 26, an annular elastic material 28 made of, for example, sponge is bonded by means of, e.g., an adhesive, while an annular elastic material 29 made of, e.g., sponge having a relatively small diameter is similarly bonded onto the outer surface of the peripheral plate portion 27A of the inner holder 27 by means of, e.g., an adhesive, so that at an interfacial boundary 35 the annular elastic materials 28 and 29 are arranged so as to forcibly contact with each other by means of elastic force of the respective annular elastic materials 28 and 29.

A pair of rails 30A and 30B extending horizontally in parallel to each other are provided on the outer surface of the front side plate 9A of the casing cover 9 in the base portion 2 at upper and lower positions so as to interpose the guide window 9B therebetween. In this arrangement, when the rotating shaft 12 transfers in right and left directions, the outer holder 26, i.e. the washing implement portion 3, may be transferred on the base portion 2 with a favorable stability and less frictional resistance, since the rear surface of the outer holder 26 slidably contacts with the rails 30A and 30B.

In this embodiment, a circular protuberance portion 31 having a slightly smaller diameter than the distance between the rails 30A and 30B on the casing 9 is formed on the rear surface of the outer holder 26 and as a result, the circular protuberance portion 31 is guided by the rails 30A and 30B when the outer holder 26, i.e. the washing implement portion 3, is transferred, so that the same can more stably be transferred.

In the above construction, an opening 32 for passing the spring pin 15 in the rotating shaft 12 therethrough and extending along its diametral direction is formed on the center hole portions of the outer and inner holders 26 and 27, and the extreme end of the rotating shaft 12, the outer holder 26 and the inner holder 27 are inserted into the center hole portions in order by the use of the opening 32, whereafter the base part 17 of the washing implement 4 is forcibly fitted to the extreme end of the rotating shaft 12 to secure the same. A wide engaging hole 33 having substantially the same diameter as that of the spring pin 15 is formed at the innermost portion of the split groove 16, whereby the washing implement 4 is thrust until the spring pin 15 is engaging with the engage hole 33 while expanding the split groove 16 by means of the spring pin 15, so that the spring pin 15 is fastened and held by the engaging hole 33, thereby securing the washing implement 4 to the rotating shaft 12. Thus the rear edge of the washing implement 4 extending rearwardly from the spring pin 15 abuts upon the inner surface of the inner holder 27, so that the rear end portion of the washing implement 4 is suppressed so as not to move outwardly.

Meanwhile legs 34A and 34B each projecting rearwardly and downwardly are formed on the respective rear and lower end surfaces in the right and left end portions of the base portion 2, so that the load of the base portion 2 is supported by the legs 34A and 34B in the case where the base portion 2 is held on the surface of a wall by means of suction cups 6, and thus the base portion 2 is fixed on the wall surface in a horizontally extended state.

In this state, the washing implement 4 is impregnated with a cleaning fluid, and a cup to be washed is put on the washing implement 4 from its extreme end. In this case the extreme edge of the cup is guided to a position corresponding to that of the interfacial boundary 35 of the annular elastic materials 28 and 29 bonded to the outer holder 26 and the inner holder 27, respectively, and as a result, the cup is located at a substantial center of the washing implement 4.

Thus such situation that the washing implement 4 is covered by the cup may be attained, and in this situation the cup can simply be washed by moving reciprocally the cup in the direction of the groove along the extending direction of the base portion 2 while holding the bottom portion of the cup by the hand of the operator. In this case, the washing implement 4 is guided by means of the guide window 9B and the guide groove 8B, and the pinion 11 rolls on the rack 10 in accordance with this movement, thereby rotating the washing implement 4 on its own axis together with the rotating shaft 12 of the pinion 11. In this occasion, the inner circumference and the inside of the bottom portion of the cup are scrubbed with the washing material piece 23 of the washing implement 4. The direction of rotation of this washing implement 4 is switched by switching the direction of movement with respect to the base portion 2 in accordance with reciprocating motion, thus the dirt on the inner surface of the cup is positively scrubbed off.

In the above description of this embodiment, although base portion 2 extends rectilinearly in its horizontal direction, a base portion extending with a certain curvature may also be utilized in accordance with necessity. In such arrangement of a curved base portion, the washing operation can easily be effected by performing an arcuate motion by means of an operator's hand with her (or his) elbow as the center in case of carrying out reciprocating motion of the washing implement portion 3.

A direction for attaching the base portion 2 and a construction of fittings may be modified as occasion demands. Furthermore various types of washing material pieces other than a sponge, such as a brush, a cloth and the like, may also be utilized.

As described above, according to the present invention, the washing material piece can be rotated by reciprocally turning reversely the same in such a manner that the washing material piece scrubs the inner surface of a hollowware having a relatively deep depth in accordance with only such simple operation that the hollowware covering the washing implement is subjected to reciprocating motion while holding the hollowware by an operator's hand. In this case since a part which is directly touched by the operator's hand is merely the outside of the hollowware, her (or his) hand is not contaminated by a detergent, and further there is no necessity for operating other instrument(s) such as a sponge and the like to scrub the hollowware thereby by means of the other hand of the operator. In addition since the washing machine of this invention does not require a motor or the like for motive power, the entire construction of the washing machine can be made simple and compact.

In the above-mentioned embodiment, since the bearer 25 for hollowware is provided between the washing implement 4 and the base portion 2 and two annular elastic materials 28 and 29 are fixed to the bearer 25 for hollowware, a hollowware to be washed is suitably located over the washing implement 4.

Moreover since the washing implement 4 is rotatably mounted on the rotating shaft 12 as described in the above embodiment, the washing material piece 23 of the washing implement 4 may suitably be modified dependent upon shapes or types of hollowwares to be washed.

Figure 6:
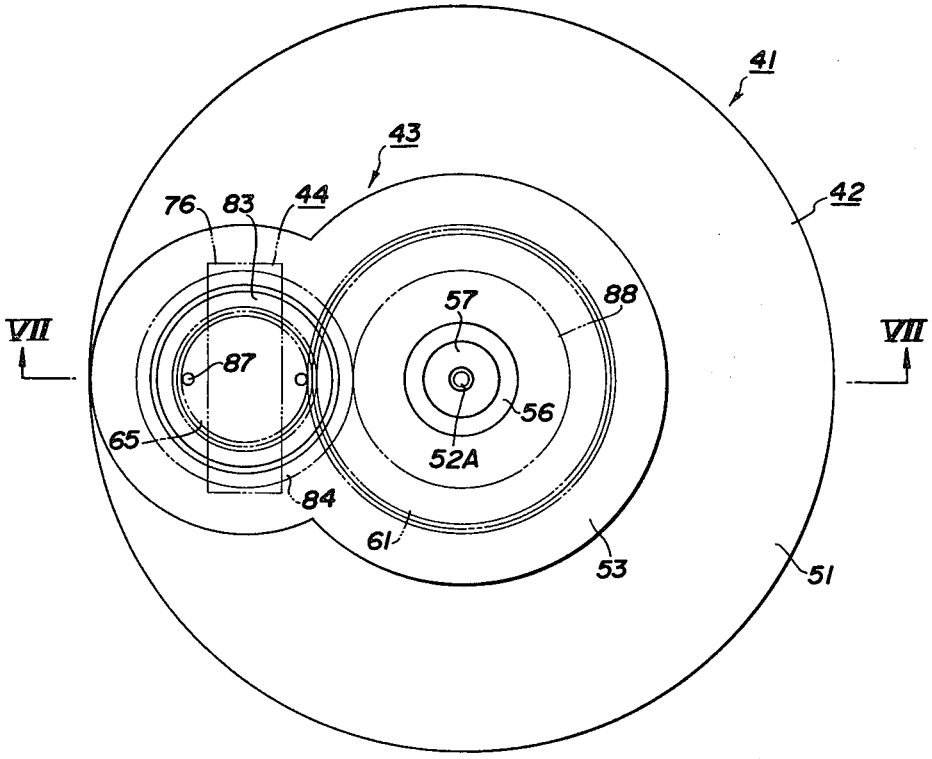
FIG. 6 is a plan view showing another embodiment of a washing machine for hollowwares according to the invention.
Figure 7:
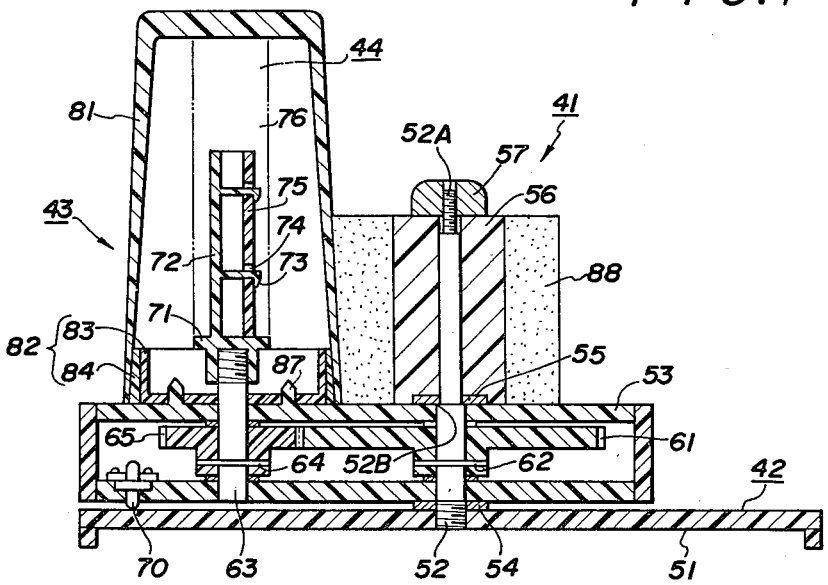
FIG. 7 is a sectional view in elevation taken along line VII—VII of FIG. 6.

Referring to FIGS. 6 and 7, another embodiment of the washing machine according to this invention will be described hereinbelow. In this embodiment, a washing machine 41 for hollowwares comprises a base portion 42 and a washing implement portion 43, and the washing machine has such following construction that the washing implement portion 43 is subjected to rotary motion with respect to the base portion 2 by means of mannual operation, thereby rotating a rotary washing implement 44 on its own axis.

The base portion 42 has a base panel 51 extending horizontally and a stationary shaft 52 installed upwardly at the central position of the base panel 51, and a rotary box 53 having an eccentrically integrated double circular form (Darumaform) in its planar shape is rotatably mounted on the stationary shaft 52. In this arrangement, a lower washer 54 is interposed between the base panel 51 and the rotary box 53, while an upper washer 55 is disposed on the rotary box 53 so as to slidably contact with the upper surface thereof. A cylindrical holder 56 is fitted to the stationary shaft 52 so as to hold down the upper washer 55 from an upward direction, and a clamping nut 57 is screwed into a screw portion 52A formed at the extreme end of the stationary shaft 52 to lock the cylindrical holder 56 at the upper end thereof. The upper washer 55 is engaged with a stepped portion 52B formed on the stationary shaft 52 at the position of the upper surface of the rotary box 53, whereby the cylindrical holder 56 is clamped and secured between the upper washer 55 and the nut 57, and at the same time the rotary box 53 is rotatably held between the upper washer 55 and the lower washer 54.

A stationary gear 61 is integrally mounted on the stationary shaft 52 by means of a spring pin 62 at such position that the stationary shaft 52 faces the inner surface of the rotary box 53. The stationary gear 61 meshes with a rotary gear 65 secured to a rotating shaft 63 by means of a spring pin 64, and the rotating shaft 63 is rotatably held by the rotary box 53. In this arrangement, when the rotary box 53 rotates on the base panel 51 with the stationary shaft 52 as its center, the rotary gear 65 turns about the periphery of the stationary gear 61 while meshing therewith, thereby rotating the rotary gear 65 and the rotating shaft 63 on its own axis with respect to the rotary box 53. In this embodiment, the gear ratio between the stationary gear 61 and the rotary gear 65 is selected to be value such that when the rotary box 53 makes one revolution, the rotary gear 65 and the rotating shaft 63 make three revolutions on their own axis.

A roller or ball 70 contacting rotatably with the upper surface of the base panel 51 is mounted on the lower surface of the end portion of the rotary box 53 in the side on which the rotating shaft 63 is mounted, whereby the rotary box 53 can smoothly be rotated.

The upper end portion of the rotating shaft 63 projects upwardly from the rotary box 53 substantially parallel to the stationary shaft 52, and the washing implement 44 is attached to the projected end of the rotating shaft 63. The washing implement 44 comprises a base part 71 fixed integrally to the rotating shaft 63 to rotate therewith, a standing-up plate 72 extending upwardly from the base part 71, and a stopper plate 75 having an engaging hole 74 which engages with an engaging piece 73 projected transversely from one side of the standing-up plate 72. An inside washing material piece 76 made of a rotating sponge is held by sandwiching the same between the standing-up plate 72 and the stopper plate 75. In this embodiment, the inside washing material piece 76 is made to be a vertically elongated strip-form as a whole so as to be suitable for washing a hollowware, e.g., cup 81, and the size of the washing material piece is selected so as to sufficiently expand in transverse and longitudinal directions from the standing-up plate 72 and the stopper plate 75 towards the outside thereof.

A bearer 82 for hollowware is provided around the rotating shaft 63 on the upper surface of the rotary box 53, and the washing implement portion 43 is formed by the washing implement 44 and the bearer 82 for hollowware. The bearer 82 for hollowware comprises a holder 83 of cylindrical form the upper surface of which is opened, and an annular washing material piece 84 made of, for example, sponge is bonded to the outer periphery of the holder 83 by the use of an adhesive, whereby the washing material piece 84 is pressingly contacted with the inner surface of the cup 81 by means of the elastic force thereof. Two engaging holes are bored on the bottom surface of the holder 83, and projecting pieces 87 projected from the upper surface of the rotary box 53 are fitted in the engaging holes, so that the holder 83 is secured on the rotary box 53.

In the arrangement as described above, the periphery of the cup 81 in the case where the washing implement 44 is covered with this cup 81 is guided by the washing material piece 84, so that the cup 81 is located and maintained at a position with the washing implement 44, the rotating shaft 63, as its center.

On the other hand, a cylindrical washing material piece 88 made of, for example, sponge and used for washing the outer surface of a hollowware is fixed on the outer periphery of the cylindrical holder 56 secured to the stationary shaft 52 by means of, for example, an adhesive. The cylindrical washing material piece 88 contacts slidably with the outer surface of the cup 81 covering the washing implement 44 in an elastic manner.

In the construction as described above, when the cup 81 is made to cover the rotating washing implement 44 to fit in the bearer 82 for hollowware, the rotating washing implement 44 contacts slidably with the inner surface of the cup 81, the washing material piece 84 slidably contacts with the periphery of the cup 81, and further the cylindrical washing material piece 88 is located at the outer circumferential surface in a slidably contacting state.

In this situation, when the bottom portion of the cup 81 is grasped and held by an operator's hand and the cup 81 is made to effect circular motion around the stationary shaft 52, the rotary box 53 rotates about the stationary shaft 52 as its center. In this case rotary gear 65 secured to the rotating shaft 63 meshes with stationary gear 61 fixed to the stationary shaft 52 to effect the revolution thereof, thereby rotating the rotary gear 65 and the rotating shaft 63 on its own axis, so that the inner periphery and inside bottom portion of the cup 81 is scrubbed with the rotating washing implement 76. Thus dirt can be scrubbed off from the inside surface of the cup 81.

Furthermore, during one revolution of the cup 81 around the stationary shaft 52, since the cup 81 moves with variation of its slidable contact position with respect to the material piece 88 for washing the outside surface of a hollowware, the outer circumferential surface of the cup 81 is rubbed with the washing material piece 88, and thus stains are scrubbed off with the washing material piece 88 from the outer circumferential surface of the cup 81.

As described above, according to the present invention, when a hollowware to be washed is operated to effect circular motion with respect to the base portion, the rotating washing implement 44 rotates on its own axis, whereby the inside of the hollowware can easily be washed. In this connection, when the rotary box 53 with the built-in stationary gear 61 and the rotary gear 65 is utilized, a washing machine for hollowwares which has a comparatively simple construction and by which a washing operation may easily be carried out can be obtained. It may be said in this connection that the rotary gear box 53 not only functions to contain gear mechanisms, but also function as base onto which a hollowware is pushed and by which the hollowware is maintained, functions to make the hollowware a positively effect circular motion, and functions to support the rotating washing implement with a relatively simple construction.

As in the embodiment described above, when the material piece for washing the periphery of a hollowware and the material piece 88 for washing the outside surface are secured to the rotary box 53, the inside of the hollowware as well as the peripheral portion and outer circumferential surface thereof can concurrently be washed.

What is claimed is:

1. A washing machine for washing hollowwares comprising:

casing means having secured to the interior thereof stationary teeth means;

rotary gear means meshing with said stationary teeth means and rotatably mounted in the interior of said casing means;

a rotating shaft projected outwardly from said casing means and connected to said rotary gear means;

a washing implement mounted on a projected end of said rotating shaft, said washing implement adapted to be covered with a hollowware to be washed; and said rotary gear means being movable along said stationary teeth means by means of a hollowware held by an operator's hand, thereby rotating said rotary gear means, said rotating shaft and said washing implement about the axis of said rotating shaft.

2. A washing machine as claimed in claim 1, wherein said stationary teeth means comprises a rack, said rotary gear means comprises a pinion meshing with said rack, said casing means comprises a stationary casing with said rack and pinion therein, said rotating shaft projects through a guide hole formed in said casing, further comprising a bearer for a hollowware provided exteriorly of said washing implement mounted on the projected end of said rotating shaft, such that said washing implement is adapted to be covered with the hollowware to be washed with the hollowware held by the operator's hand being subjected to reciprocating motion along said guide hole, thereby causing said pinion, said rotating shaft and said washing implement to rotate about the axis of said shaft while turning reversely in the same direction as the reciprocal motion of the hollowware.

3. A washing machine as claimed in claim 2, wherein two annular elastic materials for receiving the extreme end of the hollowware are concentrically fixed to said bearer, and the hollowware is adapted to be subjected to reciprocating motion together with said washing implement and said bearer with the extreme edge of the hollowware inserted in an interfacial boundary between said annular elastic materials.

4. A washing machine as claimed in claim 2, wherein a pair of rails extending horizontally and parallel to each other are provided on a surface of said casing opposite to said bearer so as to interpose said guide hole between said rails, and said bearer is slidably movable on said rails.

5. A washing machine as claimed in claim 2, wherein said washing implement is detachably mounted on an extreme end of said rotating shaft.

6. A washing machine as claimed in claim 2, wherein said washing implement comprises a base part fitted to said rotating shaft, a standing-up plate extending outwardly from said base part and integral therewith and a stopper for setting a washing material piece onto said standing-up plate so as to sandwich said washing material piece between said stopper and standing-up plate.

7. A washing machine as claimed in claim 1, wherein said casing means comprises a rotary box rotatably mounted about a stationary shaft, fixed to the center of a base portion, said stationary teeth means comprises a stationary gear positioned within said rotary box and fixed to said stationary shaft, said rotary gear means comprises a rotary gear fixed to a rotating shaft supported rotatably within said rotary box, said rotating shaft having an end projecting outwardly from said rotary box, and said washing implement is mounted on the projected end of said rotating shaft and is adapted to be covered with a hollowware to be washed, such that the hollowware may be held by the operator's hand and subjected to circular motion together with said rotary box about said stationary shaft, thereby rotating said rotary gear, said rotary shaft and said washing implement about the axis of said rotary shaft.

8. A washing machine as claimed in claim 7, wherein a material piece for washing the periphery of the hollowware is provided on a surface position of said rotary box at a location adjacent the periphery of the hollowware covering said washing implement.

9. A washing machine as claimed in claim 7, wherein a material piece for washing the outer surface of the hollowware is provided on a surface position of said rotary box at a location adjacent the outer surface of the hollowware covering said washing implement.

* * * * *